United States Patent [19]

Sherman et al.

[11] Patent Number: 4,850,595

[45] Date of Patent: Jul. 25, 1989

[54] CROSSWORD PUZZLE GAME

[75] Inventors: Barry C. Sherman, Westlake Village; Mitchell M. Geffen, Encino, both of Calif.

[73] Assignee: Mabco, Inc., Inglewood, Calif.

[21] Appl. No.: 137,753

[22] Filed: Dec. 24, 1987

Related U.S. Application Data

[63] Continuation of Ser. No. 778,855, Sep. 23, 1985, abandoned.

[51] Int. Cl.[4] ..... A63F 9/18

[52] U.S. Cl. ..... 273/240; 273/272

[58] Field of Search ..... 273/240, 272, 153 R, 273/139, 269; 434/177

[56] References Cited

U.S. PATENT DOCUMENTS

| | | | |
|---|---|---|---|
| 2,290,266 | 7/1942 | Bechtold | 273/240 |
| 3,195,895 | 7/1965 | Kropinski | 273/240 |
| 4,179,126 | 12/1979 | Coefield | 273/240 |
| 4,384,722 | 5/1983 | Higgins | 273/272 |

*Primary Examiner*—Leo P. Picard

*Attorney, Agent, or Firm*—Charles H. Schwartz; Ellsworth R. Roston

[57] ABSTRACT

A method and apparatus for playing a competetive crossword puzzle game including a crossword puzzle having individual word portions having associated definitions constituting clues for the solving of the individual word portions of the puzzle. Additional numerical indicia associated with each individual word portion representing the length of each word forming a word portion. Marking apparatus for filling in the individual word portions of the crossword puzzle in distinguishable characters. A die including numerical indicia on different ones of the sides of the die and with each indicia constituting the number of letters representing the length of the word to be used for filling in the individual word portions of the crossword puzzle. The players taking turns filing in the individual word portions of the crossword puzzle using the marking apparatus. Each turn for each player including rolling the die to determine the length of the word to be filled in by the player. Each player during each individual turn matching the numerical indicia provided by the roll of the die with the additional numerical indicia and awarding points to each player based on the length of each word filled in correctly by each player during their respective turns.

15 Claims, 2 Drawing Sheets

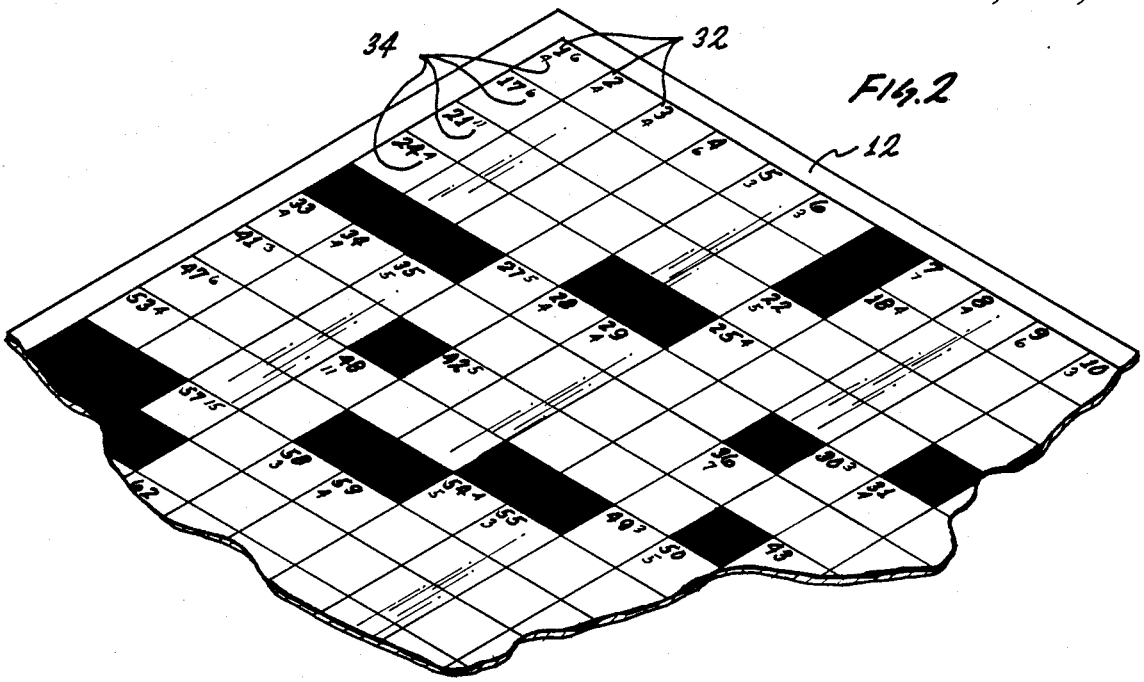
Fig. 2
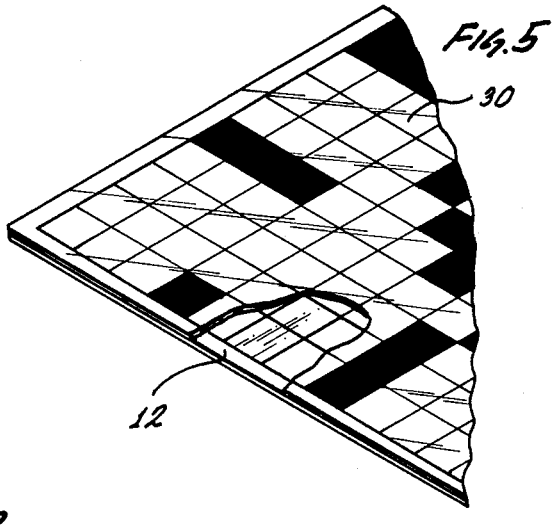
Fig. 5
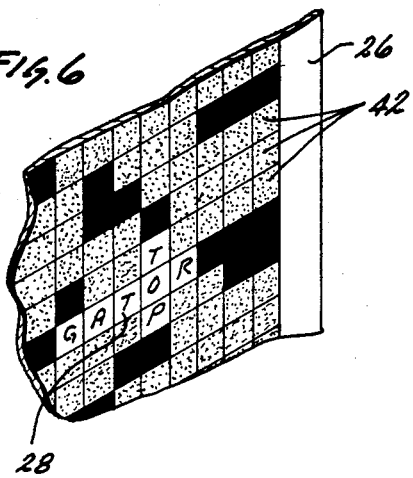
Fig. 6
Fig. 3
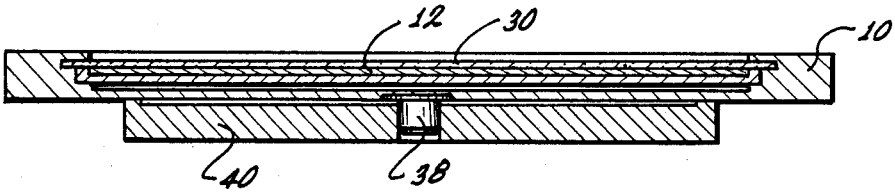
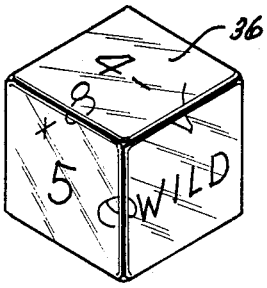
Fig. 4a
Fig. 4b
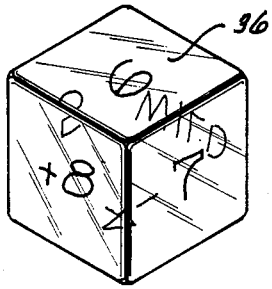

CROSSWORD PUZZLE GAME

This is a continuation of application Ser. No. 778,855 filed Sept. 23, 1985 now abandoned.

BACKGROUND OF THE INVENTION

1. Field of the Invention

The present invention relates to a crossword puzzle game and more specifically, to a competitive crossword puzzle game to be played by two or more players or teams of players.

2. Description of the Prior Art

Crossword puzzles are well known throughout the world as a constructive method of both entertainment and education. These crossword puzzles come in a wide variety of complexity and degrees of difficulty and almost every individual can find a crossword puzzle suited to their level of skill and intelligence.

In its earliest form, the crossword puzzle was provided as a children's game in the early part of the century. In the 1920's the crossword puzzle was expanded to its present form and featured in major newspapers throughout the United States and in foreign countries. However, the traditional crossword puzzle is generally solved by a single individual or perhaps two individuals cooperatively filling out the same puzzle. This type of activity does not include competition between different individuals and does not provide for the crossword puzzle being used as a spectator game.

There have been numerous attempts in the past to use the basic structure of a crossword puzzle to provide for a competitive game. Most of these prior art attempts, although sharing some similarities with a crossword puzzle, do not truly form a crossword puzzle game in which clues or definitions form the basis for generating an interlocking pattern of words. Other types of game equipment do provide for the game incorporating a true crossword puzzle, but with the equipment either being cumbersome in nature or lacking certain aspects which would create an exciting and stimulating competitive game for a number of players.

As an example of prior art attempts to provide a competitive crossword puzzle game, reference is made to U.S. Pat. Nos. 4,106,773 and 4,209,173. In U.S. Pat. No. 4,106,773, a crossword puzzle game is disclosed wherein contestants take turns filling in the crossword puzzle and with each contestant using a different color marker. In addition, the length of each turn is measured by a timer. Values are assigned to each square in the crossword puzzle and the winner of the game is determined at the end of play by adding up the values assigned to each square filled in correctly in each color. This puzzle game does not include any element of chance and there is provision for confirming whether a word portion of the puzzle has been filled in correctly.

In U.S. Pat. No. 4,209,173, a puzzle game is disclosed wherein the players themselves form the crossword puzzle as the game is played. This structure makes a very slow game and also, this game does not include any element of chance.

Other prior art games also share some of the limitations of the above two described games and include even further limitations which hamper their effectiveness as a competitive game for a plurality of players.

SUMMARY OF THE INVENTION

The present invention provides for a crossword puzzle game which is very competitive in nature and also includes an element of chance so as to enhance the excitement as the game is played. The game equipment includes a game board, which game board is formed as a flat surface to support a replaceable sheet printed with a complete crossword puzzle. A different replaceable sheet is use for each game. The sheet may be coated so that it can be erasable or the puzzle sheet may be positioned under a transparent sheet formed from material such as mylar which is also erasable. The game board may be also formed to be supported and may be on a lazy susan structure so as to allow the game board to be rotated to the different players during the play of the game.

The puzzle sheets include the normal marking for a crossword puzzle which are numerals at the different square positions so as to tie into clues which are either across or down. The puzzle sheet of the present invention includes additional numerical indicia to indicate the length of each word to be filled in for each portion of the puzzle sheet. This additional numerical indicia may be printed in a contrasting color to the normal markings of the puzzle sheet. This additional numerical indicia greatly speeds up the playing of the game, since each player can quickly scan the board and determine which words are available of a particular length for answering.

The use of the additional numerical indicia ties in with the chance portion of the game since the crossword game of the present invention includes a die, such as a six sided die. Listed on each side of the die are numbers representing the number of letters of a word to be filled in. For example, the die may include numbers representing the following number of letters; Four or less, five, six, seven, eight or more and wild. When the player rolls the die, the number that comes up determines the length of the word that must be filled in during that player's turn. If the wild side of the die comes up, then the player can fill in any length word.

The game equipment also includes multiple clue sheets, one for each individual player for each puzzle sheet and with each clue sheet including a strategy area. The individual players can then plan ahead while other players are taking their turns, so that each player can try to anticipate possible answers for the next turn.

The game equipment of the present invention also includes an answer sheet for each puzzle sheet and with the answer sheet normally covered by an opaque material to obscure the answer sheet. This opaque material may then be selectively removed in an appropriate area to reveal an individual correct answer. Specifically, during the playing of the game, any player can challenge another player's answer and with the answer sheet being used to confirm the correct answer without revealing the remaining portions of the puzzle sheet. The answer sheet, for example, may have the entire answer printed and then covered with an easily removable paint such as the type of silver paint currently used for lottery, supermarket and fast food type games. This paint is easily removed in selected areas, using the edge of a coin or other such instrument.

In the playing of the game, the players take turns rolling the die to determine the length of the word which is to be answered. If desired, each word to be filled in may have to include at least one letter of a word previously filled in. The additional numerical indicia on the puzzle sheet enables the player to quickly scan the puzzle sheet to determine the words which are available to be filled in, in accordance with the roll of the die. A player can challenge an answer and then with the correctness of the answer confirmed using a selected revealed portion of the answer sheet without revealing the entire puzzle. The combination of the use of the die to provide for a chance element in the game plus the use of the challenge provides for an exciting and competitive crossword game while allowing for the possibility that an inferior player can win over a superior player.

BRIEF DESCRIPTION OF THE DRAWINGS

A clearer understanding of the present invention will be had with reference to the following description and drawings wherein;

FIG. 2 is a fragmentary view of a portion of the puzzle sheet showing the various indicia.

FIG. 3 is a cross-sectional view of the game board illustrating the game board mounted on a lazy susan.

FIGS. 4*a* and 4*b* show the various side of the die used in the game;

FIG. 5 is a fragmentary view of the puzzle sheet as covered by an erasable sheet of transparent material; and FIG. 6 is a fragmentary view of the answer sheet illustrating a number of answers exposed without revealing the remaining portions of the answer sheet.

DESCRIPTION OF THE PREFERRED EMBODIMENT

Figure 1:
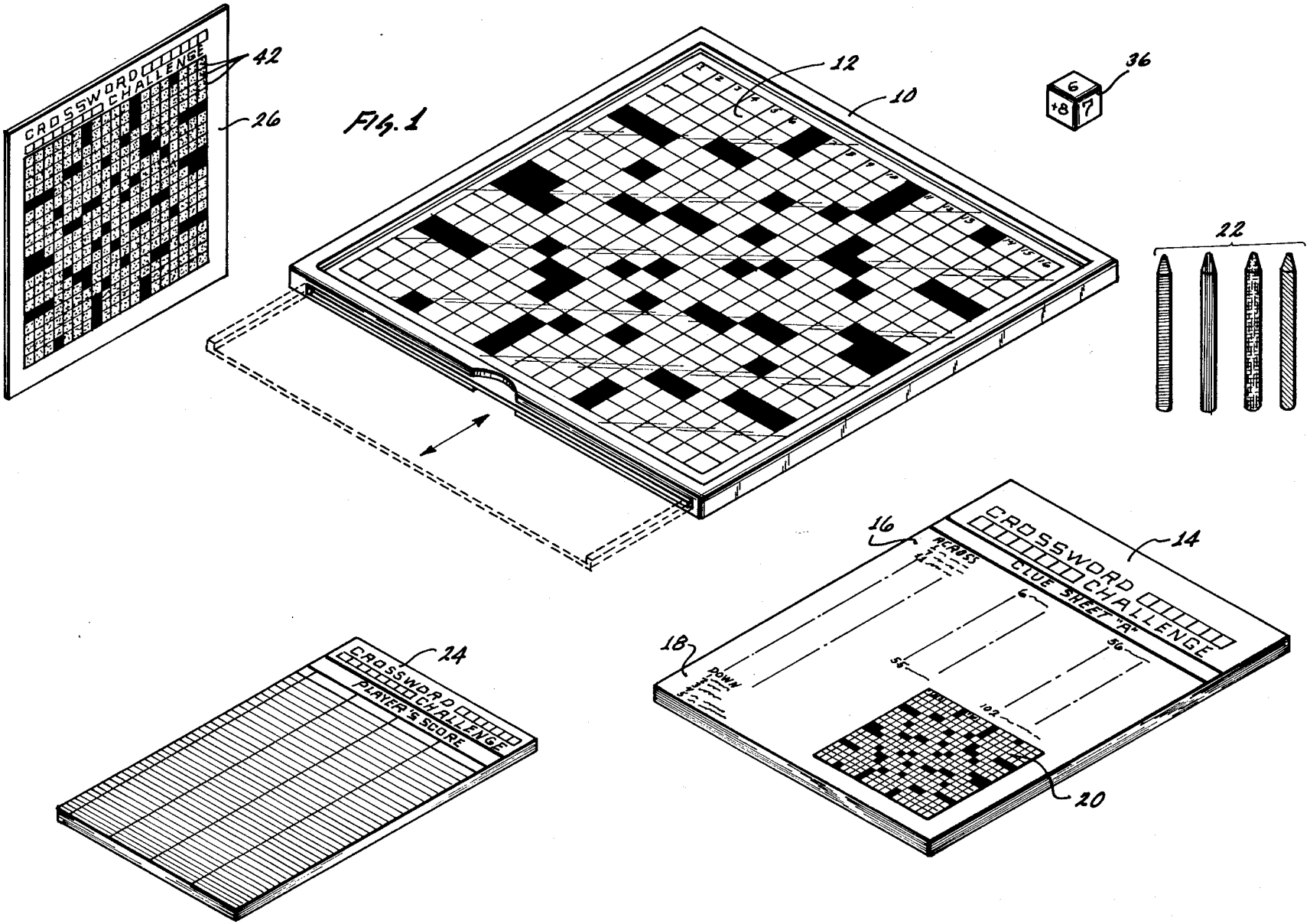
FIG. 1 is a perspective view of the various pieces of the game equipment forming the crossword puzzle game of the present invention.

FIG. 1 illustrates the various pieces of equipment forming the complete game of the present invention. As shown in FIG. 1, a game board 10 is designed to receive and support a replaceable puzzle sheet 12. As can be seen, the puzzle sheet 12 may be slid or placed into and out of the game board so that new puzzle sheets can be inserted for each new game. The replaceable puzzle sheets are standard crossword puzzles having the various squares numbered to tie in with clues to the individual word portions, which clues are for words either across or down.

Each player is provided with a clue sheet 14 to tie into the puzzle sheet 12, which clue sheet includes the various definitions for the word portions, either across as shown at position 16, or down at position 18. The clue sheets may also include a replica, as shown at position 20, of the puzzle sheet 12 so that each player may plan forward strategy by filling in additional words which may be useful to the individual player at later portions of the game. Each player may also be given one of a plurality of different color crayons 22 so that each player may be identified with a different color during the playing of the game. This allows the player's score to be easily filled out on a score card such as a score card 24.

During the playing of the game any player may challenge the answer inserted by another player. The correctness of the challenge may be verified by an answer sheet which is a duplicate of the puzzle sheet 12, but with all of the answers printed in. After the answers are printed in, the sheet is then covered with an opaque material such as a silver paint which may be selectively removed to reveal an individual answer without exposing the remaining portion of the puzzle. As an example, as shown in FIG. 6, the answer sheet is shown to have individual answers 28 exposed but with the remaining answers obscured unless challenged by another player.

Each puzzle sheet may be coated with a clear material so that a player can change his answer by wiping off the crayon. Also an answer may be removed if incorrect and if challenged by another player. FIG. 5 illustrates an alternative structure wherein the puzzle sheet 12 is covered by a separate sheet of transparent material such as a sheet of mylar 30. The use of the mylar 30 easily allows the crayon to be removed when desired.

A fragmentary view of the puzzle sheet 12 is shown greatly enlarged in FIG. 2. As seen in FIG. 2, the puzzle sheet includes two types of numerical indicia. One type of indicia is the normal consecutively numbering of individual squares, as shown at positions 32, to tie in to the clues 16 and 18 printed in the clue sheet 14. This type of numerical indicia is substantially identical to that present on standard crossword puzzles.

In addition to the indicia 32, the puzzle sheet 12 also includes additional numerical indicia representing the length of the word portion to be filled in either across or down for the individual word answers. This additional indicia is shown at positions 34 and may be printed in a contrasting color to the normal indicia. As an example, in square number 1, two additional indicia are shown representing a six letter word across and a four letter word down. In square number 2, one additional indicia is shown representing a four letter word down. In square number 21, one additional indicia is shown representing an eleven letter word across.

The use of the additional numerical indicia 34 ties in with another piece of the game equipment which is a die 36. As shown in FIGS. 4*a* and 4*b*, the die may be six sided and include the following indicia; 4−, 5, 6, 7, 8+ and wild. These indicia represent the length of the word to be filled in during each player is turn. 4− represents words of four or less letters. 5, 6, and 7 represent words of five, six and seven letters. 8+ represents words of eight or more letters and wild represents a word of any length. The indicia on the die ties into the additional numerical indicia 34 on the puzzle sheet so that when a player rolls the die and obtains the number of letters that can be filled in during each turn, the player can scan the puzzle sheet to locate those words which have the appropriate number of letters corresponding to the roll of the die.

During the playing of the game, the game board is rotated from player to player during each turn. In order to facilitate this rotation, the game board 10 may be mounted on a lazy susan as shown in FIG. 3. Specifically, the game board 10 includes a pivot member 38 which is supported by a bearing opening in a stationary block 40. The game board may then be rotated from position to position around the stationary base 40.

As the game is played, each player may challenge the correctness of another player's answer. The correctness of the challenge can be ascertained using the answer sheet 26. As shown in the enlarged fragmentary portion of FIG. 6, the answer sheet is a complete replica of the puzzle sheet 12 and with the answers filled in but obscured by opaque material 42. This material, for example, may be the same type of silver paint used in the instant winner lotteries and in the games played by customers of supermarkets or fast food restaurants. The silver paint may be selectively rubbed off to reveal the underlying printing of a particular word answer. When an answer is challenged, the appropriate portion relating to that answer is selectively removed and the correct answer revealed without revealing other answers.

During the playing of the game, the initial step is to have each player roll the die to determine who goes first. The player who rolled the highest number goes first and with the wild side of the die considered the highest number. The player with the highest number roll may then fill in any word on the puzzle sheet 12. The next player then rolls the die and with the number rolled corresponding to the number of letters to be filled in by the player. In general, each new word filled in must include one letter of the word previously filled in so that the answers on the puzzle sheet develop in a contiguous fashion. If the roll of the die provides for the wild side being up, then the player can answer a word of any length any place on the puzzle sheet.

Each player uses his own colored crayon to fill in the answer, so that the score may be kept track of for each player either continuously or at the end of the game. With each roll of the die, the player uses the additional numerical indicia 34 on the puzzle sheet to quickly determine which available words may be filled in since the numerical indicia 34 corresponding in number to the roll of the die are the only available words for the player to fill in. When a player rolls the die during his turn and there is no proper length word available, then the player may be given a second roll.

Any time after a player writes in an answer, another player may challenge the correctness of the answer. As indicated above, the answer sheet 26 allows the challenge to be verified without exposing the entire puzzle. If the answer is correct, then the player gets the score and the challenging player loses a turn. If the answer is incorrect, then the challenging player gets the score and the original player may lose his next turn.

The scorecard may be used to keep score as the game progresses or at the end of the game. Each time a word is filled in, the number of letters may determine the score for that particular word. If a player finishes an entire section the player may get credit, not only for the word that was filled in, but all the other words filled in by finishing the section. This would greatly increase the score when a player finishes a section.

The present invention therefore provides for a unique, competitive crossword puzzle game and a method of playing that game which includes not only a high level of competitiveness but a certain degree of chance. The chance is provided by the use of a die so that each player during each turn is constrained to answer a word in accordance with the roll of the die. This tends to equalize players of different skills and to insure that no one player will always win on the basis of superior skill. The use of a wild side on the die further increases the element of chance and additionally opens up the competitive level of the game.

The additional numerical indicia 34 on the game board, which numerical indicia may be printed in a contrasting color such as red, allows the player during each turn to scan the board to see the various eligible answers dictated by the roll of the die. The use of the additional numerical indicia therefore enhances the speed of the game so since the player does not have to laboriously determine which are the eligible possibilities during each turn.

The use of the answer sheet allows for the confirmation of the challenge without revealing the entire puzzle. The answer sheet therefore allows for the challenge aspect of the game which further increases the competitiveness and excitement of the puzzle game of the present invention.

Although the present invention has been described with reference to a particular embodiment, it is to be appreciated that various adaptations and modifications may be made and the invention is only to be limited by the appended claims.

We claim:

1. A method for players to play a competitive crossword puzzle game using apparatus including;

a crossword puzzle having individual word portions having associated definitions constituting clues for the solving of the individual word portions of the puzzle, marking apparatus for filling in the individual word portions of the crossword puzzle in distinguishable characters, and a die including numerical indicia on different ones of the sides of the die and with each indicia constituting the number of letters representing the length of the word to be used for filling in the individual word portions of the crossword puzzle, the method characterized as follows, the players taking turns filling in the individual word portions of the crossword puzzle using the marking apparatus, each turn for each player including rolling the die to determine the length of the word to be filled in by the player, and awarding points to each player based on the length of each word filled in correctly by each player during their respective turns.

2. The method of claim 1 wherein the game apparatus includes the crossword puzzle having additional numerical indicia associated with each individual word portion representing the length of each word forming a word portion and the additional step of each player during each individual turn matching the numerical indicia provided by the roll of the die with the numerical indicia associated with particular word portions to fill in the particular word portions which are eligible to be filled in during an individual turn.

3. The method of claim 1 wherein the game apparatus additionally includes an answer sheet in the form of a completely filled in crossword puzzle and with the answer sheet covered with a selectably removable opaque material and with the additional steps of each player after another player's turn challenging the correctness of a filled in particular individual word portion at the discretion of each player and selectively moving an appropriate portion of the opaque material from the answer sheet to expose the correct answer to the particular individual word portion without exposing the remaining portions of the answer sheet.

4. The method of claim 1 wherein the game apparatus includes the die having six sides having numerical indicia on five sides representing the following number of letters; four or less, five; six; seven; and eight or more, and a sixth wild side representing any number of letters and the additional step of each player during each individual turn filling in any word portion when the roll of the die provides the wild side.

5. The method of claim 4 wherein after the first word portion has been filled in, the step of filling in the individual word portions must include at least one letter previously filled in unless the roll of the die provides the wild side.

6. The method of claim 1 wherein after the first word portion has been filled in, the step of filling in the individual word portions must include at least one letter previously filled in.

7. The method of claim 1 the game apparatus additionally includes multiple clue sheets each having a replica of the crossword puzzle and associated definitions and with the additional step of each player privately solving individual word portions for filling in the crossword puzzle at a later time.

8. The method of claim 1 wherein the game apparatus additionally includes the crossword puzzle mounted on a lazy susan and with the additional step of rotating the crossword puzzle to face the individual players during their respective turns.

9. A method of playing a competitive crossword puzzle game using apparatus including;

a crossword puzzle having individual word portions having associated definitions constituting clues for the solving of the individual word portions of the puzzle, marking apparatus for filling in the individual word portions of the crossword puzzle in distinguishable characters, and an answer sheet in the form of a completely filled in crossword puzzle and with the answer sheet covered with a selectably removable opaque material, the method characterized as follows, the players taking turns filling in the individual word portions of the crossword puzzle using the marking apparatus, each player after another player's turn challenging the correctness of a filled in particular word portion at the discretion of each player, removing an appropriate portion of the opaque material from the answer sheet after a challenge to expose the correct answer to the particular individual word portion without exposing the remaining portions of the answer sheet, and awarding points to each player based on the length of each word filled in correctly by each player during their respective turns.

10. The method of claim 9 wherein the game apparatus includes a die including numerical indicia on different ones of the sides of the die and with each indicia constituting the number of letters representing the length of the word to be used for filling in the individual word portions of the crossword puzzle, and includes the crossword puzzle having additional numerical indicia associated with each individual word portion representing the length of each word forming a word portion and with the additional steps during each turn for each player including rolling the die to determine the length of the word to be filled in by the player, and matching the numerical indicia provided by the roll of the die with the numerical indicia associated with particular word portions to determine the particular word portions which are eligible to be filled in during an individual turn.

11. The method of claim 10 wherein the game apparatus includes the die having six sides having numerical indicia on five sides representing the following number of letters; four or less, five; six; seven; and eight or more, and a sixth wild side representing any number of letters and the additional step of each player during each individual turn filling in any word portion when the roll of the die provides the wild side.

12. The method of claim 11 wherein after the first word portion has been filled in, the step of filling in the individual word portion must include at least one letter previously filled in unless the roll of the die provides the wild side.

13. The method of claim 9 wherein after the first word portion has been filled in, the step of filling in the individual word portion must include at least one letter previously filled in.

14. The method of claim 9 wherein the game apparatus additionally includes multiple clue sheets each having a replica of the crossword puzzle definitions and with the additional step of each player privately solving individual word portions for filling in the crossword puzzle at a later time.

15. The method of claim 9 wherein the game apparatus additionally includes the crossword puzzle mounted on a lazy susan and with the additional step of rotating the crossword puzzle to face the individual players during their respective turns.

* * * * *